US008424471B2

(12) United States Patent
Zhu

(10) Patent No.: US 8,424,471 B2
(45) Date of Patent: Apr. 23, 2013

(54) FOLDABLE BANQUET TABLE

(76) Inventor: Shou Qiang Zhu, Hong Kong (HK)

( * ) Notice: Subject to any disclaimer, the term of this patent is extended or adjusted under 35 U.S.C. 154(b) by 49 days.

(21) Appl. No.: 13/068,011

(22) Filed: Apr. 28, 2011

(65) Prior Publication Data

US 2012/0272873 A1 Nov. 1, 2012

(51) Int. Cl.
*A47B 3/00* (2006.01)

(52) U.S. Cl.
USPC ..... 108/132; 108/129

(58) Field of Classification Search ..... 108/132, 108/129, 115, 130, 131, 120; 248/439, 188.6, 248/188.91, 188
See application file for complete search history.

(56) References Cited

U.S. PATENT DOCUMENTS

| | | | | |
|---|---|---|---|---|
| 2,977,169 | A * | 3/1961 | Geller | 108/129 |
| 6,520,094 | B2 * | 2/2003 | Wen | 108/132 |
| 6,615,743 | B2 * | 9/2003 | Nien | 108/132 |
| 6,732,663 | B2 * | 5/2004 | Tsai | 108/132 |
| 6,752,091 | B2 * | 6/2004 | Glover et al. | 108/132 |
| 6,772,700 | B2 * | 8/2004 | Wong | 108/132 |
| 7,140,308 | B2 * | 11/2006 | Tsai | 108/132 |
| 7,475,642 | B2 * | 1/2009 | Shenghao et al. | 108/132 |
| 8,113,130 | B2 * | 2/2012 | Leng | 108/132 |
| 2002/0092445 | A1 * | 7/2002 | Glover et al. | 108/129 |
| 2003/0177961 | A1 * | 9/2003 | Wang | 108/130 |
| 2004/0194677 | A1 * | 10/2004 | Degen et al. | 108/132 |
| 2008/0282941 | A1 * | 11/2008 | Wise | 108/132 |

* cited by examiner

*Primary Examiner* — Jose V Chen
(74) *Attorney, Agent, or Firm* — Raymond Y. Chan; David and Raymond Patent Firm

(57) ABSTRACT

A foldable table includes a tabletop made of U-PVC material with a solid structure, a table reinforcing frame, and two leg frames. The table reinforcing frame is encirclingly mounted at a peripheral edge of the tabletop for forming an edge protector of the tabletop and for evenly distributing and supporting a downward loading force on the tabletop. The two leg frames are foldably supported at the bottom side of the tabletop to fold between an unfolded position and a fold position. Each leg frame includes a folding leg pivotally coupled with the table reinforcing frame and a folding frame pivotally extended from the bottom side of the tabletop to the folding leg. At the unfolded position, the folding leg is pivotally and outwardly folded to downwardly extend from the tabletop. At the folded position, the folding leg is pivotally and inwardly folded to rest under the tabletop.

17 Claims, 8 Drawing Sheets

FOLDABLE BANQUET TABLE

BACKGROUND OF THE PRESENT INVENTION

1. Field of Invention

The present invention relates to a table structure, and more particular to a foldable banquet table, which comprises a U-PVC tabletop for enhancing the rigidity of the tabletop in a runner-less manner.

2. Description of Related Arts

Conventional household furniture, such as dinning table, conference table or other types of work station, etc., in which its tabletop is made of wood or synthetic wood plank, has the advantageous of being substantively rigid and durable. In particularly, the one important feature of this kind of table which is integrally constructed is that the table is highly resistant to torsion. In addition, the leg frame can be directly coupled at the bottom side of the tabletop in order to secure the leg frame to the tabletop so as to enable the leg frame being folded between an unfolded position and a folded position in a stable manner. However, the use of wood plank in this kind of table has the following disadvantages: the material wood plank is heavy, inconvenience for storage and transportation, and has high consumption of wood materials.

Household furniture makes use of contemporary technologies to enable the use of light materials such as plastic for the tabletop. Accordingly, the plastic tabletop is made by blow mold injection that the plastic tabletop has a hollow structure. The use of plastic tabletop can reduce the weight and hence convenience for transportation, however, the rigidity and stability of the plastic made tabletop will be significantly decreased because the strength of this type of plastic tabletop is very weak. In addition, the plastic tabletop does not provide enough supportability and stabilization for the furniture. In other words, the loading force is not evenly distributed on each portion of the plastic tabletop so that the plastic tabletop will be deformed or even broken by the loading force.

In order to solve the problems and provide sufficient strength to the tabletop, an additional supporting structure made of metal has to be provided under the tabletop. Therefore, the cost of manufacture is highly increased and the convenience for transportation is lowered.

Accordingly, the supporting structure comprises two side runners respectively supported at two longitudinal side edge portions of the tabletop, wherein two longitudinal side channels are indented and pre-formed at the bottom side of the tabletop in order to receive the side runners respectively. In other words, the manufacturing process of the tabletop is relatively complicated to fit the side runners thereunder.

In addition, the leg frame cannot be directly coupled at the bottom side of the tabletop because of the hollow structure thereof. Therefore, the leg frame must be coupled between the side runners in order to fold between an unfolded position and a folded position. In other words, the leg frame and the tabletop do not provide an integral structure to provide protection against the force of torsion and load. This drawback in relation to the effect of torsion becomes prominent and uncovered when the table as a whole is being moved or when a relatively great external force is imposed onto the tabletop.

Since the tabletop is relatively long in size, the strength of the plastic tabletop is weak that the mid-portion of the plastic tabletop may be cracked easily due to the downward loading force. Therefore, the supporting structure further comprises a mid-runner is transversely mounted at the bottom side of the mid-portion of the tabletop and is extended between the side runners to enhance the strength of the plastic tabletop. In order to foldably attach the leg frame to the tabletop, the leg frame comprises a standing leg rotatably mounted between the side runners and a folding leg pivotally mounted between the standing leg and the mid-runner such that the standing leg is capable of pivotally folding under the tabletop. As a result, the mi-runner not only enhances the strength of the tabletop but also rigidly supports the leg frame in a foldable manner. In other words, the plastic tabletop must include the side runners and the mid-runner in order to form the banquet table.

However, the mid-runner restricts the pivotally attaching position of the folding leg. Since the mid-runner is transversely mounted at the middle of the tabletop, the folding leg must be long enough to pivotally extend from the standing leg to the mid-runner, which may weaken the strength of the folding leg. In addition, the folding leg must be extended from the mid-runner to the standing leg at an inclined manner so that the leg space at the bottom of the tabletop for the user will be limited when the leg frame is folded at folded position.

Furthermore, due to the position of the mid-runner, the tabletop cannot be modified to employ with a folding hinge at the mid-portion thereof for further overlappedly folding the tabletop in half to substantially reduce the size of the tabletop.

SUMMARY OF THE PRESENT INVENTION

The invention is advantageous in that it provides a foldable banquet table, which comprises a U-PVC tabletop for enhancing the rigidity of the tabletop in a runner-less manner.

Another advantage of the invention is to provide a foldable banquet table, wherein the table reinforcing frame is encirclingly mounted at a peripheral edge of the tabletop for forming an edge protector of the tabletop and for evenly distributing and supporting a downward loading force on the tabletop. In other words, the table reinforcing frame increases the rigidity of the tabletop that resists the external force of torsion and protects the tabletop from distortion.

Another advantage of the invention is to provide a foldable banquet table, wherein the U-PVC tabletop has a flat bottom side enabling the leg reinforcing unit directly coupled at the bottom side of the tabletop.

Another advantage of the invention is to provide a foldable banquet table, wherein the corner reinforcing member is inclinedly extended between the longitudinal edge and transverse edge of the tabletop for resisting to an external force of torsion exerted at the tabletop.

Another advantage of the invention is to provide a foldable banquet table, which has a rigid, simple, and strong structure.

Another advantage of the invention is to provide a foldable banquet table, wherein two ends of the leg reinforcing unit are extended toward the transverse edges of the tabletop to shorten the length of the folding frame of the leg frame so as to enhance the leg room for the user when the leg frame is folded at an unfolded position.

Another advantage of the invention is to provide a foldable banquet table, wherein no expensive mechanical structure is required to be employed in the present invention in order to achieve the above mentioned objects. Therefore, the present invention successfully provides an economic and efficient solution not only for providing a reinforced supporting configuration to the tabletop but also for enhancing the folding movement of the leg frame with respect to the tabletop.

Additional advantages and features of the invention will become apparent from the description which follows, and may be realized by means of the instrumentalities and combinations particular point out in the appended claims.

According to the present invention, the foregoing and other objects and advantages are attained by a foldable table, which comprises a tabletop made of U-PVC material with a solid structure, a table reinforcing frame, and two leg frames.

The tabletop has and a top side and a bottom side, and defines two longitudinal edges and two transverse edges as a peripheral edge of the tabletop.

The table reinforcing frame comprises a table edge surrounding frame encirclingly mounted at a peripheral edge of the tabletop for forming an edge protector of the tabletop and for evenly distributing and supporting a downward loading force on the tabletop.

The two leg frames are foldably supported at the bottom side of the tabletop to fold between an unfolded position and a fold position, wherein each of the leg frames comprises a folding leg pivotally coupled with the table reinforcing frame and a folding frame pivotally extended from the bottom side of the tabletop to the folding leg, such that at the unfolded position, the folding leg is pivotally and outwardly folded to downwardly extend from the tabletop and at the folded position, the folding leg is pivotally and inwardly folded to rest under the tabletop.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
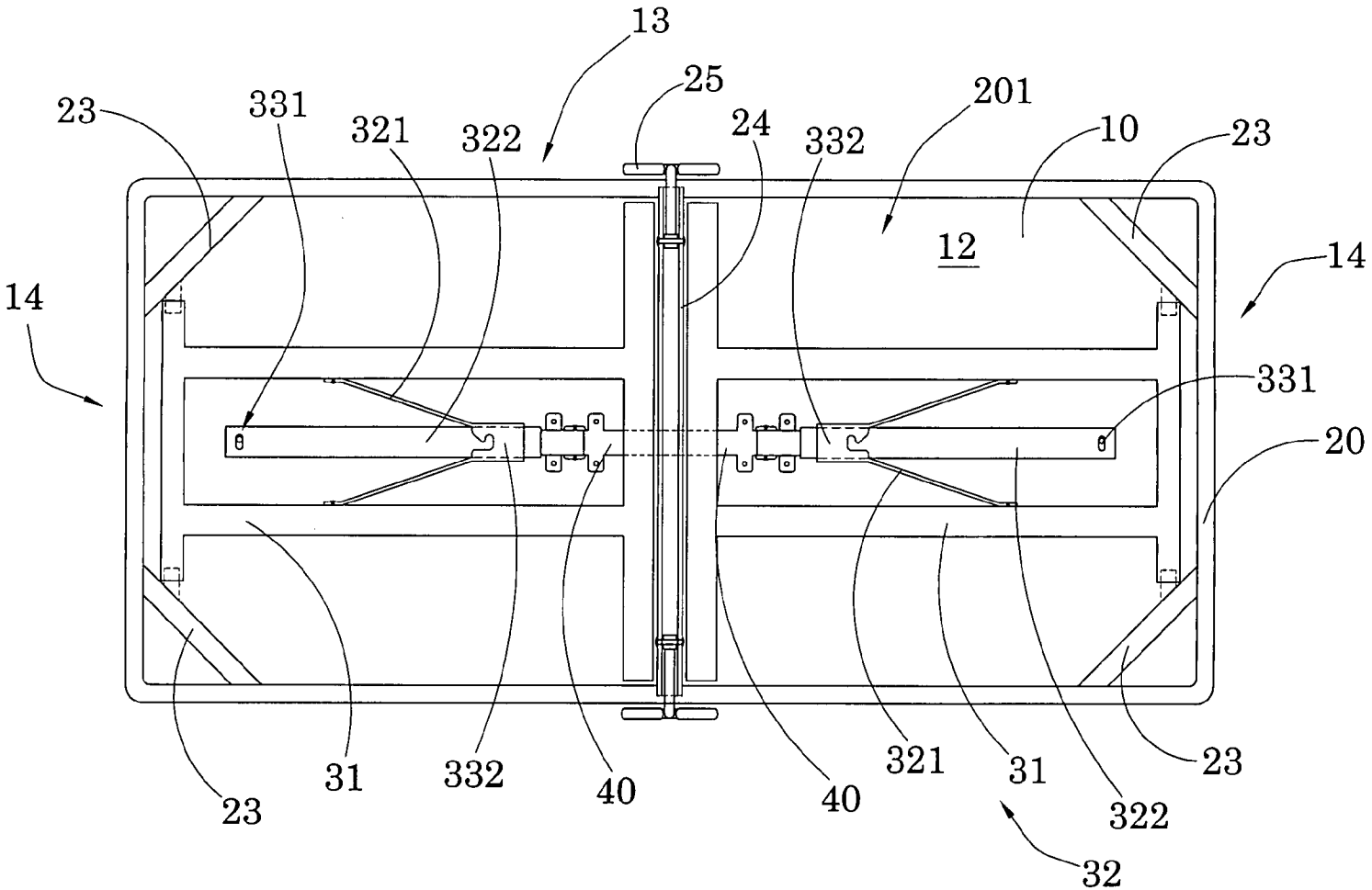
FIG. 1 is a bottom view of a foldable banquet table according to a preferred embodiment of the present invention.

Referring to FIGS. 1 to 7 of the drawings, a foldable table, such as a banquet table, according to a preferred embodiment of the present invention is illustrated, wherein the foldable table comprises a tabletop 10 made of U-PVC material with a solid structure, a table reinforcing frame 20, and two leg frames 30.

Accordingly, the tabletop 10, preferably having a rectangular shape, has a top side 11, a bottom side 12, and a peripheral edge defining two longitudinal edges 13 and two transverse edges 14.

The table reinforcing frame 20 is encirclingly mounted at the peripheral edge of the tabletop 10 for evenly distributing and supporting a downward loading force on the tabletop 10. Accordingly, the table reinforcing frame 20 forms an edge protector of the tabletop 10 to prevent any impact at the peripheral edge thereof. Preferably, the table reinforcing frame 20 has two longitudinal portions aligned along the longitudinal edges 13 of the tabletop 10, two transverse portions aligned along the transverse edges 14 of the tabletop 10, and a plurality of corner portions aligned at the corners of the tabletop 10, wherein the longitudinal portions, transverse portions, and corner portions are coupled end-to-end to form a rectangular shape to encircle around the peripheral edge of the tabletop 10. In other words, the table reinforcing frame 20 also forms a torsion resistance frame rigidly coupling the tabletop 10 for resisting an external force of torsion exerted at the tabletop 10.

The leg frames 30 are foldably supported at the bottom side 12 of the tabletop 10 to fold between an unfolded position and a fold position, wherein each of the leg frames 30 comprises a folding leg 31 pivotally coupled with the table reinforcing frame 20 and a folding frame 32 pivotally extended from the bottom side 12 of the tabletop 10 to the folding leg 31. Accordingly, at the unfolded position, the folding leg 31 is pivotally and outwardly folded to downwardly extend from the tabletop 10 and at the folded position, the folding leg 31 is pivotally and inwardly folded to rest under the tabletop 10.

According to the preferred embodiment, the solid structure of the tabletop 10 is defined that the tabletop 10 is rigid and does not have a hollow structure. Therefore, there is no empty space between the top side 11 and the bottom side 12 in comparison with the conventional plastic tabletop made by blow-mold injection which has an air cavity between the top surface and the bottom surface. It is worth mentioning that the top and bottom sides 11, 12 of the tabletop 10 are two smooth and flat surfaces, wherein no indention or channel is formed at the bottom side 12 of the tabletop 10. In other words, the tabletop 10 of the present invention is formed as the conventional wood tabletop to have a flat bottom surface. Therefore, the U-PVC tabletop 10 of the present invention is as rigid as the wood tabletop and is as light as the blow-molded plastic tabletop.

U-PVC composition is an environmental friendly product which is made of lead free and non-toxic material, wherein the U-PVC tabletop 10 does not require any vulcanization process and has no discoloration to prolong the life span of the tabletop 10. In addition, the tabletop 10 made of U-PVC is lightweight, fire retardant, acid and alkali resistance, and has characteristics of sound insulation, anti-deformation, waterproof, and thermal insulation. Throughout the testes of elongated at break, Schaefer hardness, impact strength of free beam, heating size ratio, variance ratio of heating size, softening point, bending strength, bending elasticity ratio, and strength of holding screw, all the results of the tabletop 10 of the present invention are better than these of the conventional blow-molded tabletop. In addition, the tabletop 10 of the present invention can be colored or printed on the top side 11 to enhance the aesthetic appearance of the tabletop 10.

According to the preferred embodiment, a height of the table reinforcing frame 20 is larger than a thickness of the tabletop 10 to define a receiving cavity 201 under the bottom side 12 of the tabletop 10, wherein the leg frame 30 is folded within the receiving cavity 201 at the folded position.

The table reinforcing frame 20 comprises a table edge surrounding frame 21 encirclingly mounted at the peripheral edge of the tabletop 10 for forming the edge protector of the tabletop 10 and for evenly distributing and supporting the downward loading force on the tabletop 10, and a table retention frame 22 integrally and downwardly extended from the table edge surrounding frame 21 below the bottom side 12 of the tabletop 10 to define the receiving cavity 201 within the bottom side 12 of the tabletop 10 and the table retention frame 22. In other words, the height of the table reinforcing frame 20 is defined as the overall height of the table edge surrounding frame 21 and the table retention frame 22.

Figure 2:
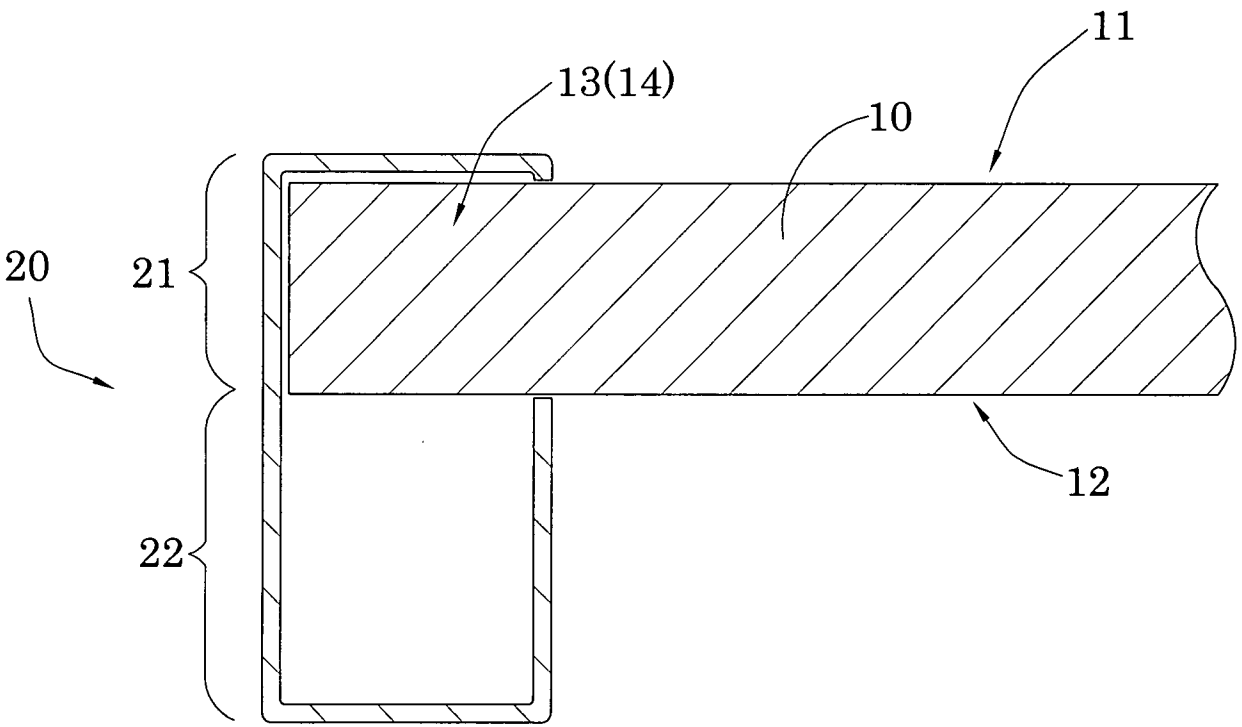
FIG. 2 is a sectional view of the table reinforcing frame with the tabletop of the foldable banquet table according to the above preferred embodiment of the present invention.

As shown in FIG. 2, the table reinforcing frame 20 has a "G"-shaped cross section having a flat side portion aligning along the peripheral edge of the tabletop 10, a flat top portion aligning on the top side 11 of the tabletop 10, and a bottom portion aligning on the bottom side 12 of the tabletop 10, wherein an elongated opening is formed to receive the peripheral edge portion of the tabletop 10. Accordingly, the table reinforcing frame 20 can be made of metal, plastic or other suitable materials to enhance the torsion resistance of the tabletop 10.

Figure 3:
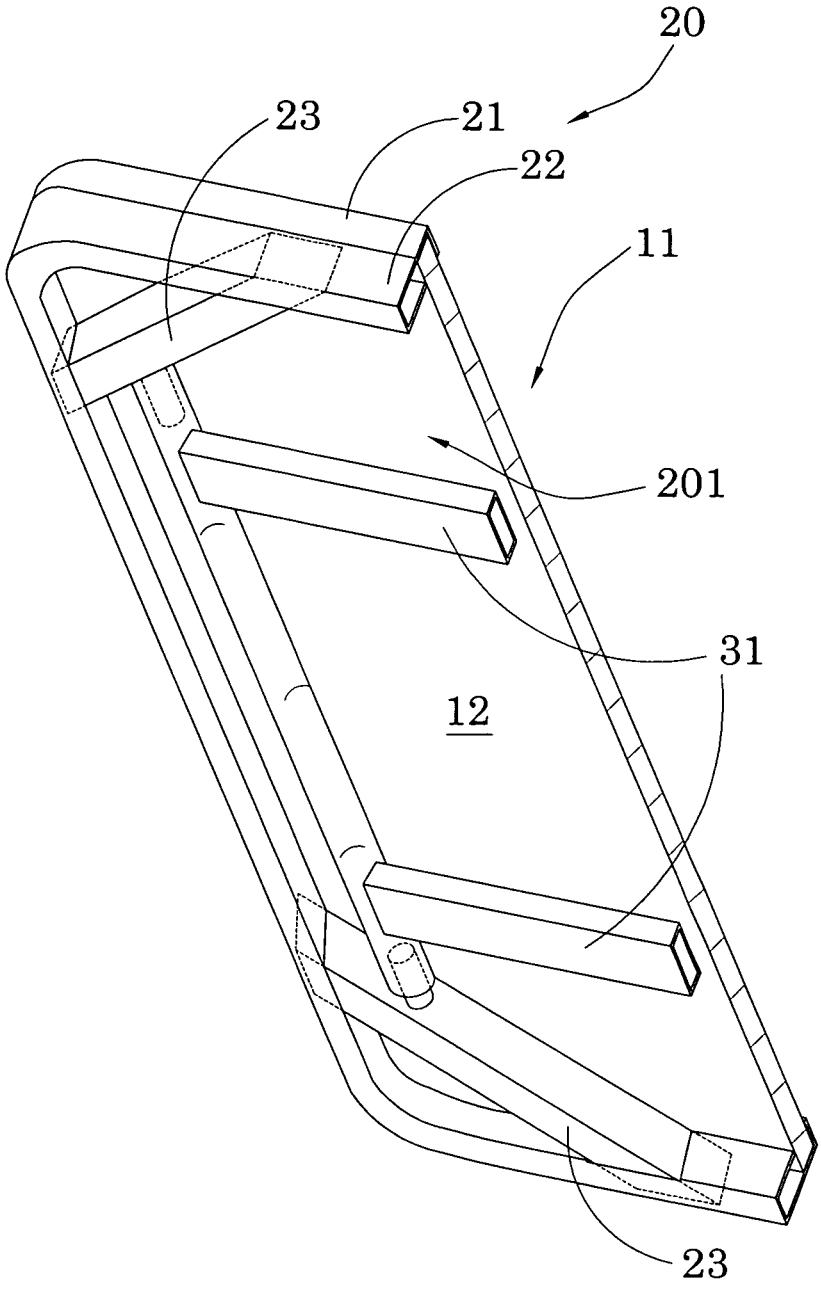
FIG. 3 is a perspective view of the corner reinforcing member of the foldable banquet table according to the above preferred embodiment of the present invention.

The table reinforcing frame 20 further comprises a plurality of corner reinforcing members 23 positioned at corners of the bottom side 12 of the tabletop 10 respectively, as shown in FIG. 3, wherein each of the corner reinforcing members 23 is inclinedly extended between the longitudinal edge 13 and the transverse edge 14 of the tabletop 10 for resisting to an external force of torsion exerted at the tabletop 10. Accordingly, four corner reinforcing members 23 are located at four corners of the tabletop 10.

In addition, each of the corner reinforcing members 23 is coupled at the table retention frame 22 to retain the corner reinforcing members 23 at the bottom side 12 of the tabletop 10. Therefore, the corner reinforcing members 23 cannot be seen from the top side 11 of the tabletop 10. Since each of the corner reinforcing members 23 is inclinedly extended between the longitudinal edge 13 and the transverse edge 14 of the tabletop 10, each of the corner portions of the table reinforcing frame 20 forms a triangular configuration to evenly distribute the loading force on the tabletop 10. In addition, the table reinforcing frame 20 with the corner reinforcing members 23 will increase the rigidity of the tabletop 10 that resists the external force of torsion and protects the tabletop 10 from distortion. In other words, having the corner reinforcing members 23, the table reinforcing frame 20 also forms the torsion resistance frame rigidly coupling the tabletop 10 for resisting an external force of torsion exerted at the tabletop 10.

Figure 4:
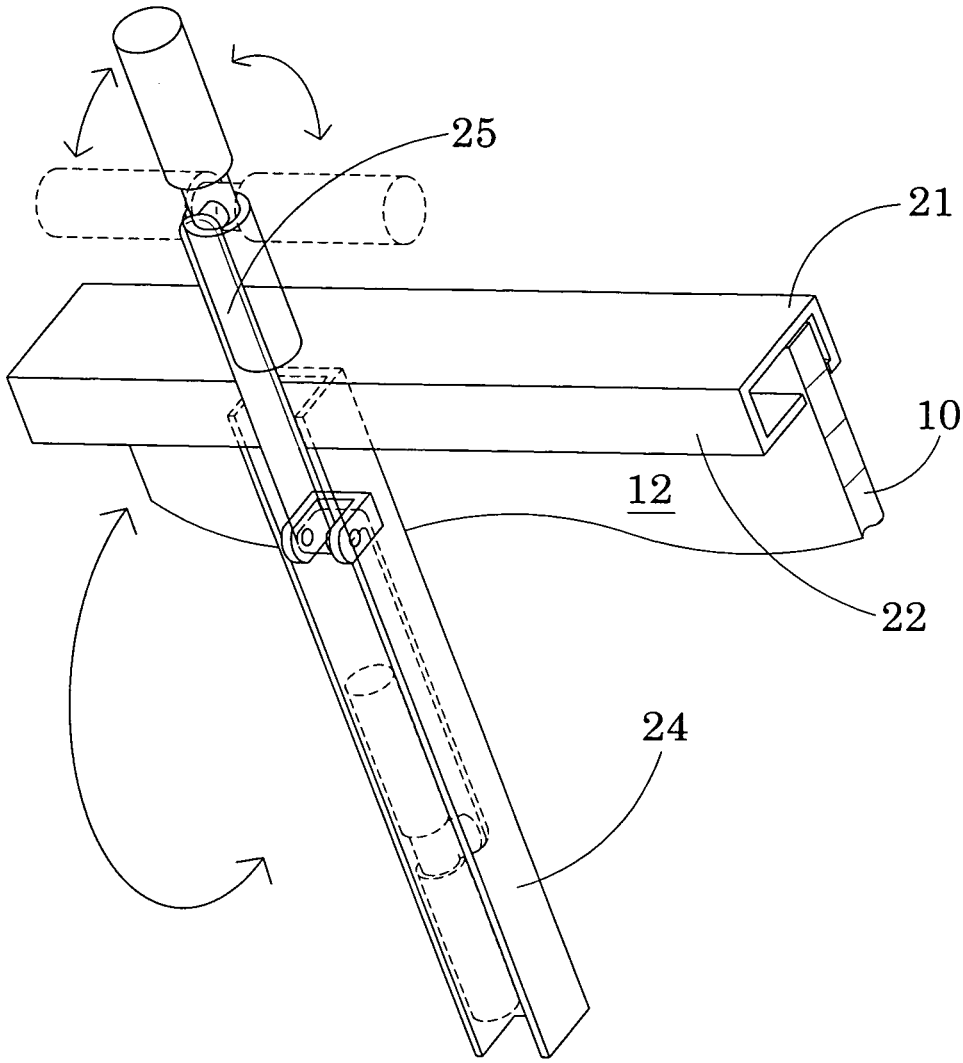
FIG. 4 is a perspective view of the transverse reinforcing member of the foldable banquet table according to the above preferred embodiment of the present invention.

As shown in FIG. 4, the table reinforcing frame 20 further comprises a transverse reinforcing member 24 transversely extended at a middle of the tabletop 10 at the bottom side 22 thereof, wherein the transverse reinforcing member 24 is extended between the two longitudinal edges 13 of the tabletop 10 for enhancing a strength of thereof. Accordingly, the transverse reinforcing member 24 is coupled at the table retention frame 22 to retain the transverse reinforcing member 24 at the bottom side 12 of the tabletop 10, such that the transverse reinforcing member 24 cannot be seen from the top side 11 of the tabletop 10. The transverse reinforcing member 24 is parallel to the transverse edges 14 of the tabletop 10 to enhance the strength the tabletop 10 at the middle thereof.

The table reinforcing frame 20 further comprises a foldable handle 25 foldably coupled with the transverse reinforcing member 24, wherein the foldable handle 25 is adapted to fold under the bottom side 12 of the tabletop 10 and to fold out of the peripheral edge of the tabletop 10, as shown in FIG. 4. The foldable handle 25 comprises a folding arm pivotally and rotatably coupled with the transverse reinforcing member 24 and a handle arm rotatably coupled with the folding arm such that the foldable handle 25 can be rotated and pivotally moved under the bottom side 12 of the tabletop 10 and can be rotated and pivotally moved out from the peripheral edge of the tabletop 10 for carrying the foldable table.

Figure 8:
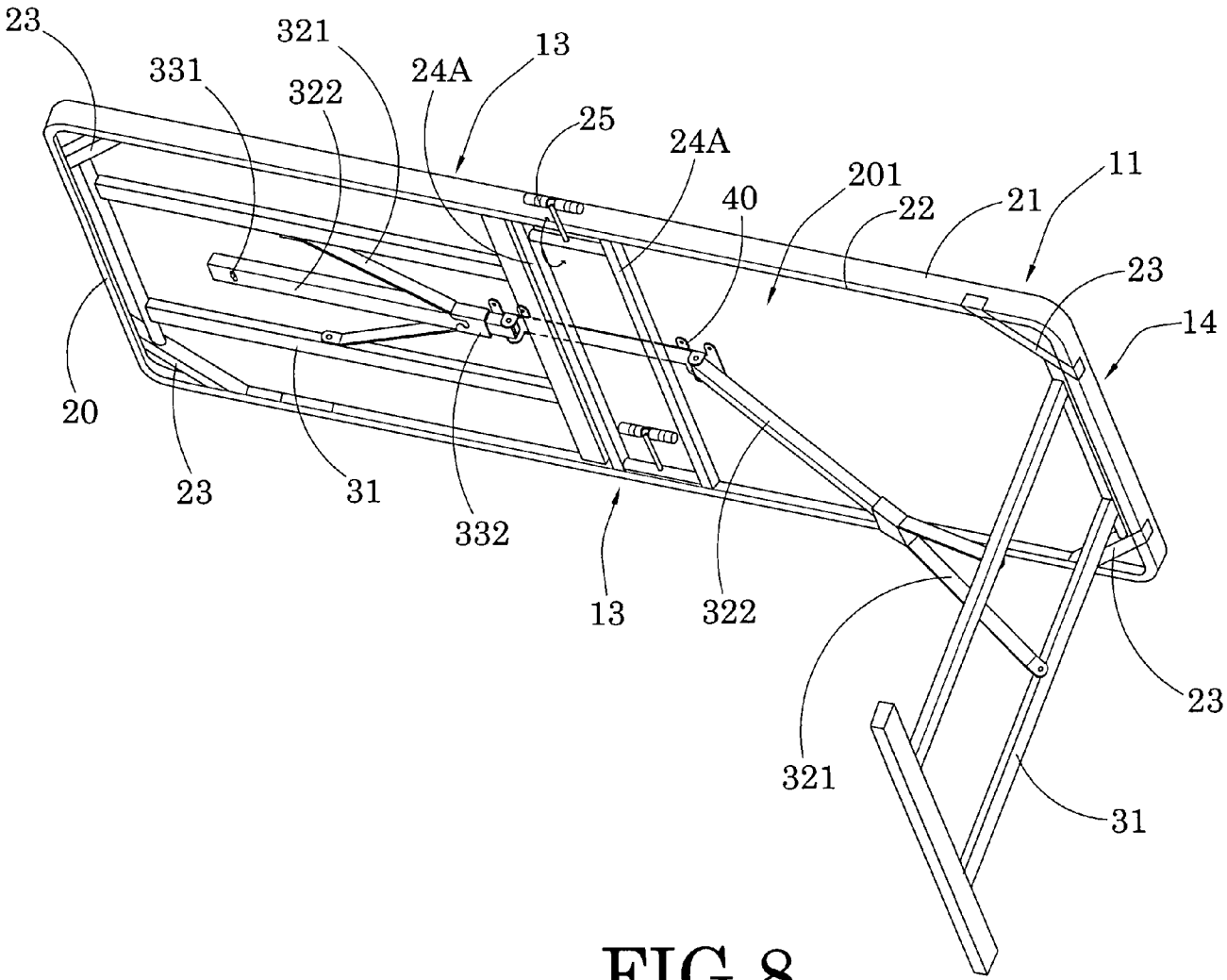
FIG. 8 illustrates an alternative mode of the transverse reinforcing member of the foldable banquet table according to the above preferred embodiment of the present invention.

Alternatively, two transverse reinforcing members 24A are spacedly transversely extended at the middle of the tabletop 10 at the bottom side 22 thereof, as shown in FIG. 8, wherein the transverse reinforcing members 24A are extended between the two longitudinal edges 13 of the tabletop 10 for further enhancing the strength of thereof. The foldable handle 25 can be pivotally coupled between the transverse reinforcing members 24A to fold under the bottom side 12 of the tabletop 10 and to fold out of the peripheral edge of the tabletop 10, as shown in FIG. 8. It is worth mentioning that the tabletop 10 can be further increased in length with two transverse reinforcing members 24A transversely extended at the middle of the tabletop 10 at the bottom side 22 thereof so as to further enhance the strength of the longer tabletop 10.

Figure 5:
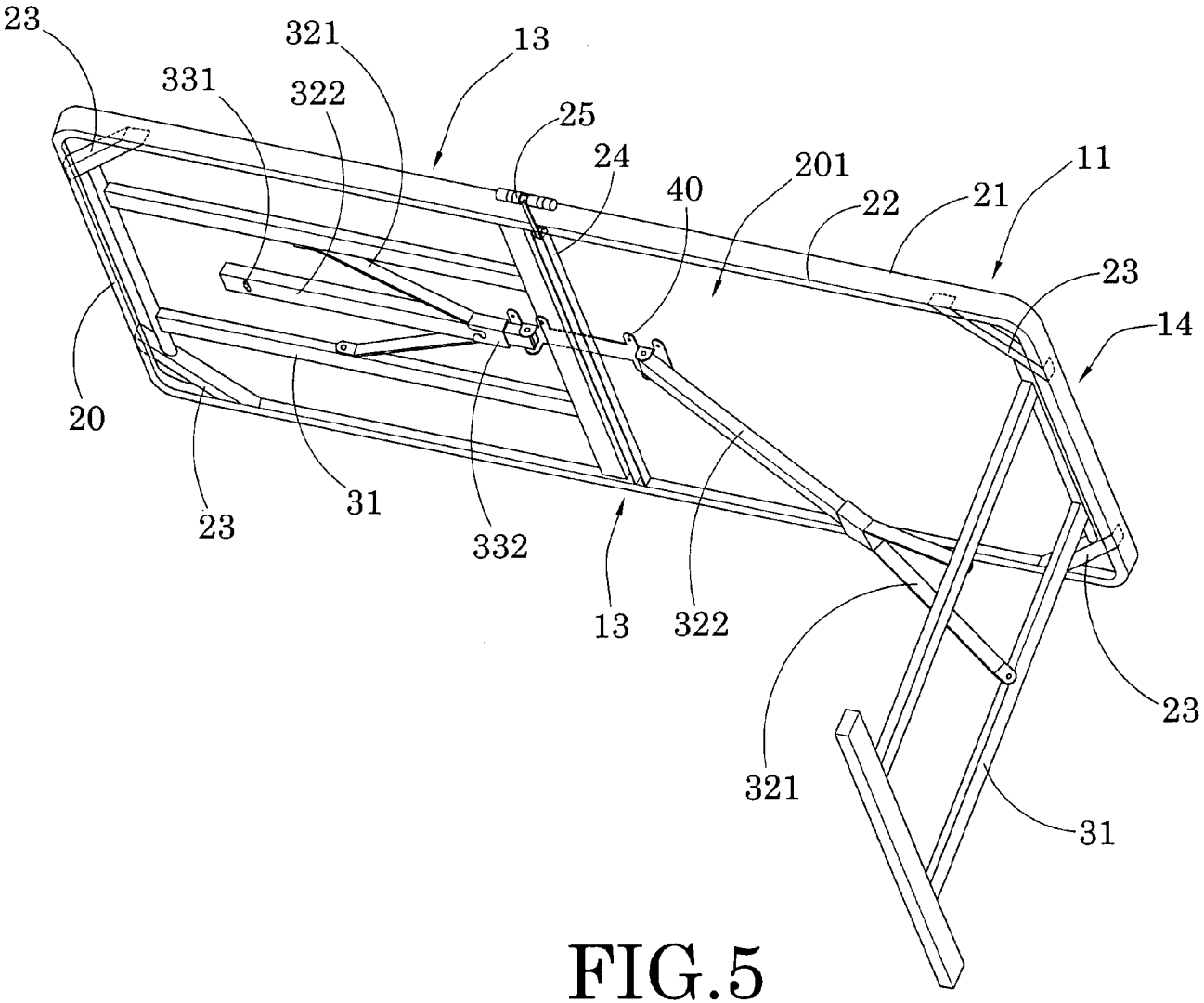
FIG. 5 is a perspective view of the leg frame of the foldable banquet table according to the above preferred embodiment of the present invention, illustrating the leg frame at the unfolded position.

As shown in FIG. 5, the folding legs 31 are pivotally supported at two transverse portions of the tabletop 10 at the bottom side 12 thereof respectively. Each of the folding legs 31 is pivotally coupled with two corresponding corner reinforcing members 23 to pivotally fold between the unfolded position and the folded position.

According to the preferred embodiment, each of the folding legs 31 has a transverse portion defining two ends pivotally coupled with the corresponding corner reinforcing members 23 and two leg portions downwardly extended from the transverse portion. The transverse portion of each of the folding legs 31 is transversely located under the bottom side 12 of the tabletop 10 in such a manner that when the transverse portion of the folding leg 31 is rotated with respect to the corner reinforcing members 23, the leg portions of the folding leg 31 are pivotally folded between the unfolded position and the folded position. At the unfolded position, the leg portions of the folding leg 31 are downwardly and outwardly folded to perpendicularly extend from the bottom side 12 of the tabletop 10. At the folded position, the leg portions of the folding leg 31 are upwardly and inwardly folded to rest on the bottom side of the tabletop 10. It is appreciated the transverse portion of the folding leg 31 can be rotatably coupled at the table retention frame 22.

In addition, each of the folding legs 31 has a flat tubular configuration that enables the folding leg 31 being folded flat on the bottom side 12 of the tabletop 10. Preferably, the leg portions of the folding leg 31 has the flat tubular configuration, wherein each leg portion of the folding leg 31 has a square or rectangular cross section that when the folding leg 31 is pivotally folded at the folded position, the leg portions of the folding leg 31 are rested on the bottom side 12 of the tabletop 10. It is worth mentioning that the width of the folding leg 31 is smaller than the depth of the receiving cavity 201 such that when the folding leg 31 is pivotally folded at the folded position, the folding leg 31 is entirely received within the receiving cavity 201. In other words, the width of the folding leg 31 is smaller than the thickness of the table retention frame 22.

Each of the folding frames 32 comprises a leg folding unit 321 pivotally coupled with the respective folding leg 31 and a leg guiding unit 322 which is pivotally extended from the bottom side 12 of the tabletop 10 and is slidably coupled with the leg folding unit 321.

The leg folding unit 321, generally having a Y-shape, has an inner end slidably coupled with the leg guiding unit 322 and two outer ends pivotally coupled with the leg portions of the respective folding leg 31 respectively.

The leg guiding unit 322, generally having an elongated structure, also has an inner end pivotally extended from the bottom side 12 of the tabletop 10 and an outer end slidably coupled with the leg folding unit 321. It is worth mentioning that the inner end of the leg folding unit 321 is slid along the leg guiding unit 322 between the inner and outer ends thereof to fold the folding leg 31 between the unfolded position and the folded position. When the inner end of the leg folding unit 321 is slid along the leg guiding unit 322 toward the outer end of the leg guiding unit 322, the folding leg 31 is folded at the unfolded position. When the inner end of the leg folding unit 321 is slid along the leg guiding unit 322 toward the inner end of the leg guiding unit 322, the folding leg 31 is folded at the folded position. It is worth mentioning that when the folding leg 31 is folded at the folded position, the leg folding unit 321 and the leg guiding unit 322 are folded to rest on the bottom side 12 of the tabletop 10. When the folding leg 31 is folded at the unfolded position, the leg folding unit 321 and the leg guiding unit 322 are folded to align with each other end-to-end and are inclinedly extended between the bottom side 12 of the tabletop 10 and the folding leg 31 so as to form a triangular configuration among the folding leg 31, the folding frame 32, and the bottom side 12 of the tabletop 10.

In addition, when the folding leg 31 is folded at the unfolded position, the length of the folding frame 32, i.e. the distance between the outer ends of the leg folding unit 321 and the inner end of the leg guiding unit 322, will be maximized since the inner end of the leg folding unit 321 is slid along the leg guiding unit 322 toward the outer end of the leg guiding unit 322 to align the leg folding unit 321 with the leg guiding unit 322 end-to-end. When the folding leg 31 is folded at the folded position, the length of the folding frame 32, i.e. the distance between the outer ends of the leg folding unit 321 and the inner end of the leg guiding unit 322, will be minimized since the inner end of the leg folding unit 321 is slid along the leg guiding unit 322 toward the inner end of the leg guiding unit 322.

In order to enhance the sliding movement between the leg folding unit 321 and the leg guiding unit 322, each of the leg frames 30 further comprises a sliding locker 33 functioning not only as a sliding joint for sliding engagement between the leg folding unit 321 and the leg guiding unit 322 but also as a lockable joint for releasably locking the leg frame 32 at the unfolded position.

According to the preferred embodiment, the sliding locker 33 comprises a locker joint 331 provided at the leg guiding unit 322 and a tubular slider 332 provided at the leg folding unit 321 to slidably couple with the leg guiding unit 322 in such a manner that when the tubular slider 332 is slid along the leg guiding unit 322 to engage with the locker joint 331 at the unfolded position, the leg folding unit 321 is locked up with the leg guiding unit 322.

Figure 6:
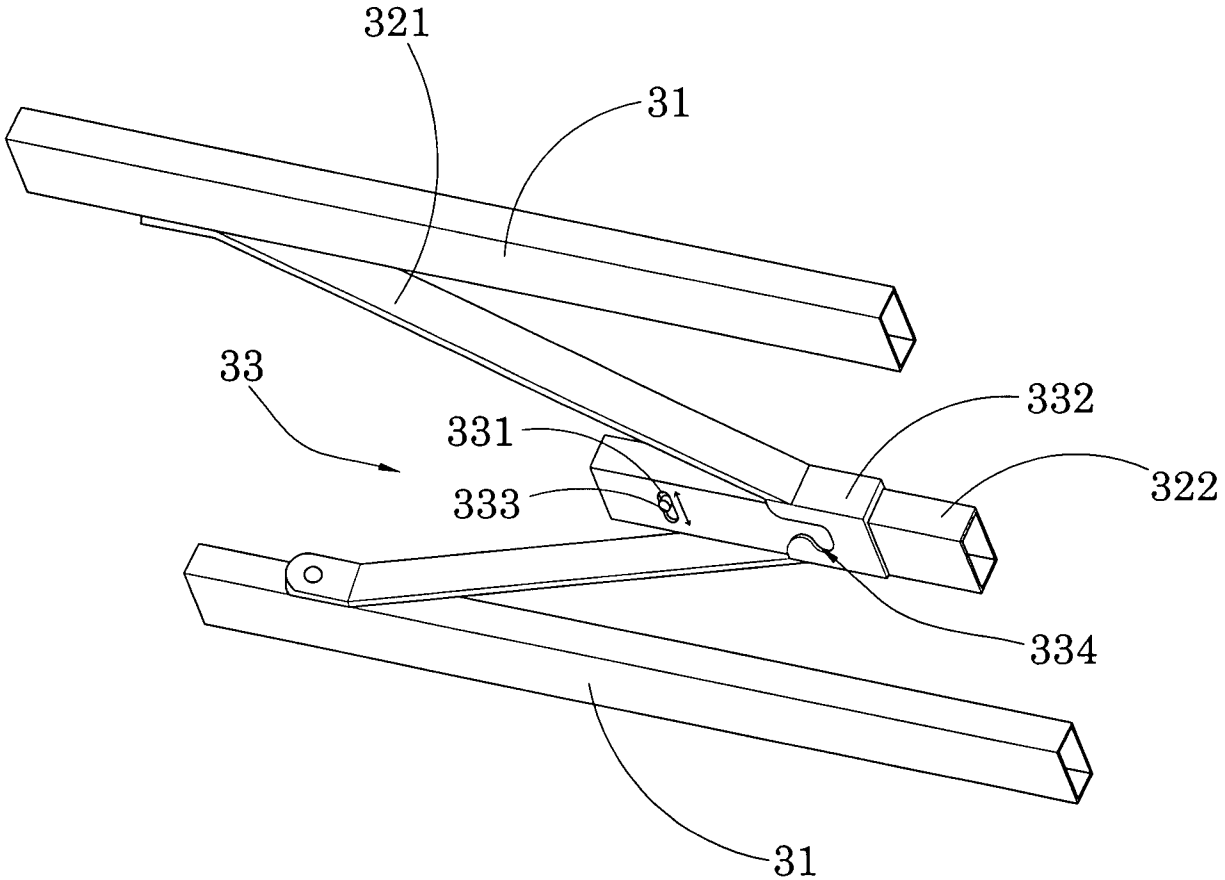
FIG. 6 is a perspective view of the slider locker of the foldable banquet table according to the above preferred embodiment of the present invention.

As shown in FIG. 6, the locker joint 331 is provided at the outer end of the leg guiding unit 322, wherein the locker joint 331 comprises a spring-loaded locker member 333 movably coupled at the leg guiding unit 322.

Correspondingly, the tubular slider 332 is provided at the inner end of the leg folding unit 321 to slidably couple with the leg guiding unit 322, wherein the tubular slider 322 is arranged to slide along the leg guiding unit 322 between the inner and outer ends thereof. The tubular slider 332 has a locking slot 334 formed thereat, wherein the locking slot 334 preferably has a L-shape defining a longitudinal guiding portion and a transverse locking portion, and a slot opening aligning with the longitudinal guiding portion for fitting the locker member 333.

Accordingly, when the tubular slider 322 is slid along the leg guiding unit 322 toward the outer end thereof, the locking member 33 is aligned to guide to the longitudinal guiding portion of the locking slot 334 through the slot opening thereof and to engage with the transverse locking portion of the locking slot 334. In other words, the locking member 33 is firstly slid at the longitudinal guiding portion of the locking slot 334 and is then slid at the transverse locking portion of the locking slot 334 to lock the locker joint 331 at the tubular slider 332, so as to lock up the leg folding unit 321 with the leg guiding unit 322 at the unfolded position.

In order to unlock the leg folding unit 321 with the leg guiding unit 322 at the unfolded position, the locking member 33 is actuated to move from the transverse locking portion of the locking slot 334 to the longitudinal guiding portion of the locking slot 334. Therefore, the tubular slider 322 is enabled to slide along the leg guiding unit 322 toward the inner end thereof so as to fold the leg frame 30 to the folded position.

According to the preferred embodiment, the foldable table further comprises a leg reinforcing unit 40 directly coupled at a mid-portion of the tabletop 10 at the bottom side 12 thereof. Preferably, the folding frame 32 is pivotally coupled between the folding leg 31 and the leg reinforcing unit 40.

Figure 7:
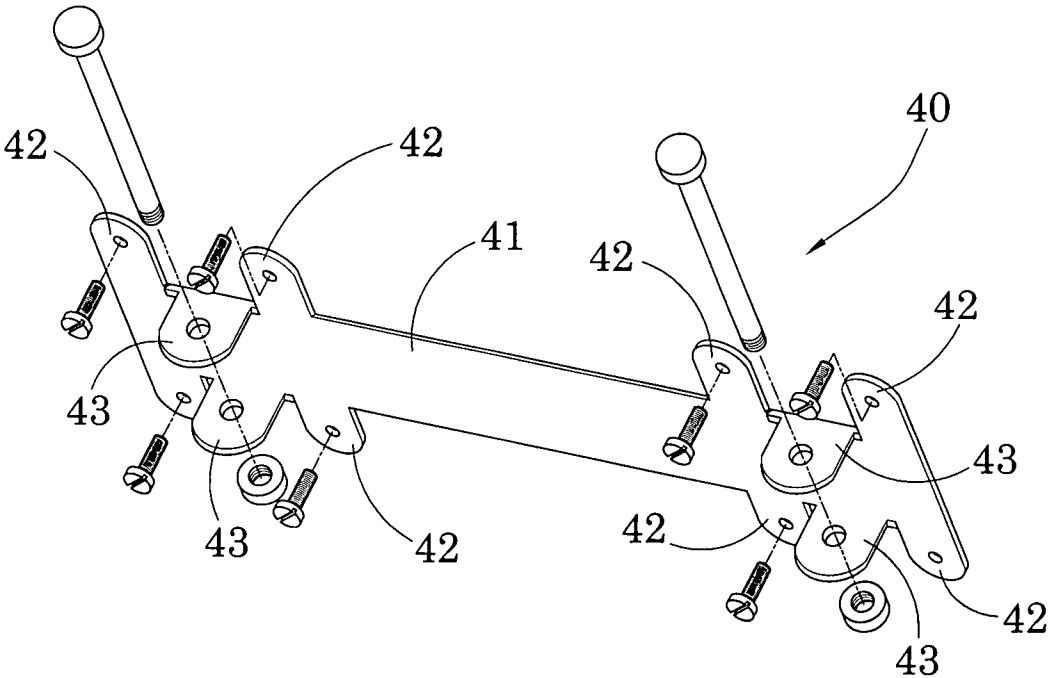
FIG. 7 is a perspective view of the leg reinforcing unit of the foldable banquet table according to the above preferred embodiment of the present invention.

As shown in FIG. 7, the leg reinforcing unit 40 is an elongated member longitudinally coupled at the bottom side 12 of the tabletop 10 at a mid-portion thereof, wherein the leg reinforcing unit 40 has two ends extended toward the transverse edges 14 of the tabletop 10 respectively to shorten the length of the folding frame 32.

Accordingly, the leg reinforcing unit 40 is coupled at the bottom side 12 of the tabletop 10 parallel to the longitudinal edges 13 of the tabletop 10. In other words, the leg reinforcing unit 40 is perpendicular to the transverse reinforcing member 24. In addition, the leg reinforcing unit 40 is sandwiched between the transverse reinforcing member 24 and the bottom side 12 of the tabletop 10. It is worth mentioning that the transverse reinforcing member 24 is not coupled at the bottom side 12 of the tabletop 10 but is coupled at the table retention frame 22 to retain the transverse reinforcing member 24 at the bottom side 12 of the tabletop 10.

Since the tabletop 10 is made of U-PVC material having the solid structure, the leg reinforcing unit 40 can be directly coupled at the bottom side 12 of the tabletop 10. Unlike the conventional blow-molded plastic tabletop, no table frame component can be directly coupled at the surface of the plastic tabletop. Therefore, the tabletop 10 of the present invention provides a rigid structure to enable any component directly coupling to the surface of the tabletop 10.

It is worth mentioning that since the leg reinforcing unit 40 can be securely sandwiched between the transverse reinforcing member 24 and the bottom side 12 of the tabletop 10, the leg reinforcing unit 40 can be retained at the bottom side 12 of the tabletop 10 without directly coupling the leg reinforcing unit 40 thereat. In addition, it is appreciated that the leg reinforcing unit 40 can also coupled with the transverse reinforcing member 24 without coupling at the bottom side 12 of the tabletop 10.

The leg reinforcing unit 40 has a predetermined length that the two ends of the leg reinforcing unit 40 are extended toward the transverse edges 14 of the tabletop 10 respectively. Therefore, the inner end of the leg guiding unit 322 is pivotally coupled at the respective end portion of the leg reinforcing unit 40 to shorten the distance of the folding frame 32. In other words, the folding frame 32 will not be extended from the folding 31 to the middle of the tabletop 10. Therefore, the shortened folding frame 32 will provides larger leg room under the tabletop 10 for the user.

As shown in FIG. 7, the leg reinforcing unit 40 has an elongated portion 41 aligned on the bottom side 12 of the tabletop 10 and a plurality of flap portions spacedly and outwardly extended along two side edges of the elongated portion 41, wherein the two ends of the leg reinforcing unit 40 are formed at the elongated portion 41. Some flap portions are defined as mounting flaps 42 directly coupled at the bottom side 12 of the tabletop 10 via fasteners such as screws. Some flap portions are bent to form pivot flaps 43 to pivotally couple with the inner end of the leg guiding unit 322. It is appreciated that the inner end of the leg guiding unit 322 can be directly coupled at the bottom side 12 of the tabletop 10 via a conventional pivot hinge.

The foldable table according to the preferred embodiment can be further modified to further reduce the overall size thereof by overlappedly folding the tabletop 10 in half. It is appreciated that a folding joint can be incorporated with the table reinforcing frame 20 at the middle of the tabletop 10, the tabletop 10 comprises a left tabletop portion and a right tabletop portion foldably coupled with each via the folding joint such that the tabletop 10 can be folded up in half.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a tabletop, which is made of U-PVC material with a solid structure, having and a top side, a bottom side, and a peripheral edge defining two longitudinal edges and two transverse edges;

a table reinforcing frame encirclingly mounted at said peripheral edge of said tabletop for evenly distributing and supporting a downward loading force on said tabletop;

a leg reinforcing unit directly coupled at a mid-portion of said tabletop at said bottom side thereof; and two leg frames foldably supported at said bottom side of said tabletop to fold between an unfolded position and a fold position, wherein each of said leg frames comprises a folding leg pivotally coupled with said table reinforcing frame and a folding frame pivotally coupled between said folding leg and said leg reinforcing unit, such that at said unfolded position, said folding leg is pivotally and outwardly folded to downwardly extend from said tabletop and at said folded position, said folding leg is pivotally and inwardly folded to rest under said tabletop, wherein each of said folding frames comprises a leg folding unit pivotally coupled with said respective folding leg and a leg guiding unit which is pivotally coupled with said leg reinforcing unit and is slidably coupled with said leg folding unit, wherein said leg folding unit has an inner end slidably coupled with said leg guiding unit and at least an outer end pivotally coupled with said folding leg, wherein said leg guiding unit has an inner end pivotally coupled with said leg reinforcing unit and an outer end slidably coupled with said leg folding unit.

2. The foldable table, as recited in claim 1, wherein said table reinforcing frame further comprises a plurality of corner reinforcing members positioned at corners of said bottom side of said tabletop respectively, wherein each of said corner reinforcing members is inclinedly extended between said longitudinal edge and transverse edge of said tabletop for resisting to an external force of torsion exerted at said tabletop, wherein said folding leg is pivotally coupled between said two respective corner reinforcing members.

3. The foldable table, as recited in claim 2, wherein a height of said table reinforcing frame is larger than a thickness of said tabletop to define a receiving cavity under said bottom side of said tabletop, wherein said leg frame is folded within said receiving cavity at said folded position.

4. The foldable table, as recited in claim 3, wherein each of said leg frames further comprises a sliding locker for releasably locking said leg frame at said unfolded position, wherein said sliding locker comprises a locker joint provided at said leg guiding unit and a tubular slider provided at said leg folding unit to slidably couple with said leg guiding unit in such a manner that when said tubular slider is slid along said leg guiding unit to engage with said locker joint at said unfolded position, said leg folding unit is locked up with said leg guiding unit.

5. The foldable table, as recited in claim 4, wherein said leg reinforcing unit is an elongated member longitudinally coupled at said bottom side of said tabletop at a mid-portion thereof, wherein said leg reinforcing unit has two ends extended toward said transverse edges of said tabletop respectively to shorten a length of said folding frame.

6. The foldable table, as recited in claim 5, wherein said table reinforcing frame further comprises a transverse reinforcing member transversely extended at a middle of said bottom side of said tabletop between said two longitudinal edges thereof for enhancing a strength of said tabletop, wherein said leg reinforcing unit is sandwiched between said transverse reinforcing member and said bottom side of said tabletop.

7. The foldable table, as recited in claim 6, wherein each of said folding legs has a flat tubular configuration that enables said folding leg being folded flat on said bottom side of said tabletop.

8. The foldable table, as recited in claim 7, wherein said table reinforcing frame comprises a table edge surrounding frame encirclingly mounted at said peripheral edge of said tabletop to form an edge protector of said tabletop.

9. The foldable table, as recited in claim 2, wherein each of said leg frames further comprises a sliding locker for releasably locking said leg frame at said unfolded position, wherein said sliding locker comprises a locker joint provided at said leg guiding unit and a tubular slider provided at said leg folding unit to slidably couple with said leg guiding unit in such a manner that when said tubular slider is slid along said leg guiding unit to engage with said locker joint at said unfolded position, said leg folding unit is locked up with said leg guiding unit.

10. The foldable table, as recited in claim 1, wherein each of said leg frames further comprises a sliding locker for releasably locking said leg frame at said unfolded position, wherein said sliding locker comprises a locker joint provided at said leg guiding unit and a tubular slider provided at said leg folding unit to slidably couple with said leg guiding unit in such a manner that when said tubular slider is slid along said leg guiding unit to engage with said locker joint at said unfolded position, said leg folding unit is locked up with said leg guiding unit.

11. A foldable table, comprising:

a tabletop, which is made of U-PVC material with a solid structure, having and a top side, a bottom side, and a peripheral edge defining two longitudinal edges and two transverse edges;

a table reinforcing frame which comprises a table edge surrounding frame encirclingly mounted at said peripheral edge of said tabletop for forming an edge protector of said tabletop and for evenly distributing and supporting a downward loading force on said tabletop, and a table retention frame integrally and downwardly extended from said table edge surrounding frame below said bottom side of said tabletop to define a receiving cavity within said bottom side of said tabletop and said table retention frame; and two leg frames foldably supported at said bottom side of said tabletop to fold between an unfolded position and a fold position, wherein each of said leg frames comprises a folding leg pivotally coupled with said table reinforcing frame and a folding frame pivotally extended from said bottom side of said tabletop to said folding leg, such that at said unfolded position, said folding leg is pivotally and outwardly folded to downwardly extend from said tabletop and at said folded position, said folding leg is pivotally and inwardly folded to rest under said tabletop, wherein each of said folding frames comprises a leg folding unit pivotally coupled with said respective folding leg and a leg guiding unit which is pivotally extended from said bottom side of said tabletop and is slidably coupled with said leg folding unit, wherein said leg folding unit has an inner end slidably coupled with said leg guiding unit and at least an outer end pivotally coupled with said folding leg, wherein said leg guiding unit has an inner end pivotally coupled with said leg reinforcing unit and an outer end slidably coupled with said leg folding unit.

12. The foldable table, as recited in claim 11, wherein said table reinforcing frame further comprises a plurality of corner reinforcing members positioned at corners of said bottom side of said tabletop respectively, wherein each of said corner reinforcing members is inclinedly extended between said longitudinal edge and transverse edge of said tabletop for resisting to an external force of torsion exerted at said tabletop, wherein each of said corner reinforcing members is coupled at said table retention frame to retain said corner reinforcing member at said bottom side of said tabletop, wherein said folding leg is pivotally coupled between said two respective corner reinforcing members, wherein a depth of said receiving cavity under said bottom side of said tabletop is larger than a width of said leg frame, such that said leg frame is folded within said receiving cavity at said folded position.

13. The foldable table, as recited in claim 12, wherein each of said leg frames further comprises a sliding locker for releasably locking said leg frame at said unfolded position, wherein said sliding locker comprises a locker joint provided at said leg guiding unit and a tubular slider provided at said leg folding unit to slidably couple with said leg guiding unit in such a manner that when said tubular slider is slid along said leg guiding unit to engage with said locker joint at said unfolded position, said leg folding unit is locked up with said leg guiding unit.

14. The foldable table, as recited in claim 11, wherein each of said folding frames comprises a leg folding unit pivotally coupled with said respective folding leg and a leg guiding unit which is pivotally extended from said bottom side of said tabletop and is slidably coupled with said leg folding unit.

15. The foldable table, as recited in claim 14, wherein said table reinforcing frame further comprises a transverse reinforcing member transversely extended at a middle of said bottom side of said tabletop between said two longitudinal edges thereof for enhancing a strength of said tabletop.

16. The foldable table, as recited in claim 15, wherein said transverse reinforcing member is transversely coupled at said table retention frame to retain said transverse reinforcing member at said bottom side of said tabletop.

17. The foldable table, as recited in claim 16, wherein each of said folding legs has a flat tubular configuration that enables said folding leg being folded flat on said bottom side of said tabletop.

* * * * *